US011828092B2

(12) United States Patent
Dente et al.

(10) Patent No.: US 11,828,092 B2
(45) Date of Patent: Nov. 28, 2023

(54) ELECTRICAL DOOR LATCH

(71) Applicant: Magna Closures S.p.A., Guasticce (IT)

(72) Inventors: Davide Dente, Pisa (IT); Emanuele Leonardi, Pisa (IT); Antonio Frello, Leghorn (IT)

(73) Assignee: MAGNA CLOSURES S.P.A., Guasticce (IT)

( * ) Notice: Subject to any disclaimer, the term of this patent is extended or adjusted under 35 U.S.C. 154(b) by 161 days.

(21) Appl. No.: 17/130,153

(22) Filed: Dec. 22, 2020

(65) Prior Publication Data

US 2021/0108451 A1 Apr. 15, 2021

Related U.S. Application Data

(63) Continuation of application No. 15/286,677, filed on Oct. 6, 2016, now Pat. No. 10,876,329.

(60) Provisional application No. 62/242,563, filed on Oct. 16, 2015.

(51) Int. Cl.

| | |
|---|---|
| ***E05B 81/86*** | (2014.01) |
| ***E05B 81/04*** | (2014.01) |
| ***E05B 81/20*** | (2014.01) |
| ***E05B 81/74*** | (2014.01) |
| *E05B 81/64* | (2014.01) |
| *E05B 81/76* | (2014.01) |

(52) U.S. Cl.

CPC ..... *E05B 81/86* (2013.01); *E05B 81/04* (2013.01); *E05B 81/20* (2013.01); *E05B 81/74* (2013.01); *E05B 81/64* (2013.01); *E05B 81/76* (2013.01)

(58) Field of Classification Search

CPC ..... E05B 81/86; E05B 81/04; E05B 81/20; E05B 81/74; E05B 1/64; E05B 81/76

See application file for complete search history.

(56) References Cited

U.S. PATENT DOCUMENTS

| | | | | |
|---|---|---|---|---|
| 5,918,917 A * | 7/1999 | Elton | E05B 81/20 292/201 |
| 6,550,825 B2 * | 4/2003 | Ostrowski | E05B 81/20 292/201 |
| 2008/0154443 A1 * | 6/2008 | Godo | B60T 13/74 188/72.1 |

(Continued)

FOREIGN PATENT DOCUMENTS

| | | |
|---|---|---|
| EP | 0694664 A1 | 1/1996 |
| WO | 2014102282 A1 | 7/2014 |

*Primary Examiner* — Mark A Williams

(74) *Attorney, Agent, or Firm* — Dickinson Wright PLLC

(57) ABSTRACT

An electrical latch for a closure system of a motor vehicle and method of operating are provided. The electrical latch includes a latching mechanism having a pawl and ratchet, a cinching mechanism having a cinching lever, and an electric actuator mechanism for actuating at least the cinching lever. The electrical latch further includes a control unit powered by a main power source and having a control circuit controlling operation of the actuator mechanism to affect the position of the cinch lever, and a backup energy source providing power to the control circuit and the actuator mechanism in the event a fault condition is experienced by the main power source. The electrical latch is configured to return the cinching lever to a home uncinched position in response to switching of power from the main power source to the backup energy source.

12 Claims, 3 Drawing Sheets

(56) References Cited

U.S. PATENT DOCUMENTS

| | | | | |
|---|---|---|---|---|
| 2008/0224482 | A1* | 9/2008 | Cumbo | E05B 81/40 292/201 |
| 2010/0052337 | A1* | 3/2010 | Arabia, Jr. | E05B 81/14 292/216 |
| 2012/0299313 | A1* | 11/2012 | Organek | E05B 81/06 292/129 |
| 2015/0069766 | A1* | 3/2015 | Estrada | E05B 77/12 292/194 |
| 2015/0091348 | A1* | 4/2015 | Juchniewicz | B60N 2/2845 297/256.16 |
| 2016/0281400 | A1 | 9/2016 | Byun et al. | |

* cited by examiner

ELECTRICAL DOOR LATCH

CROSS REFERENCE TO RELATED APPLICATION

This application is a continuation of U.S. patent application Ser. No. 15/286,677, filed on Oct. 6, 2016, which claims the benefit of U.S. Provisional Application Ser. No. 62/242,563 filed Oct. 16, 2015. The entire disclosure of the above applications are incorporated herein by reference.

FIELD

The present disclosure relates generally to door latches and, in particular, to electronic latch assemblies (commonly known as electrical latch or e-latch assemblies) such as may be employed in motor vehicle closure systems. The present disclosure also relates to a method of operating the electronic latch assembly.

BACKGROUND

This section provides background information related to the present disclosure which is not necessarily prior art.

It is known that electrical door latches (e-latch) are provided in motor vehicles, for example, for controlling the opening and closing of various closure panels such as passenger doors and liftgates. One of the defining characteristics of an e-latch is that it does not include a mechanical linkage to an outside or inside door handle. Instead, the door is released by a power-operated actuator in response to an electrical signal coming from one of the handles. The e-latch generally includes a latching mechanism having a ratchet that is selectively rotatable with respect to a striker fixed to a door post in order to latch and unlatch the door. The latching mechanism also generally includes a pawl that selectively engages the ratchet to prevent the ratchet from rotating. The e-latch also typically includes a power-operated actuator, such as an electric motor, which is electrically connected to a main electric power supply of the vehicle (e.g., the 12V battery of the vehicle) in order to directly or indirectly drive the pawl. Finally, some e-latches are equipped with a cinching mechanism configured to cinch the ratchet so as to provide a powered cinching feature.

Consequently, there are many features that can be achieved with an e-latch that would typically require complex mechanical designs or mechanisms with conventional mechanical door latches. Nevertheless, it is recognized that one disadvantage of e-latches is the reliance on electrical power for operation. As a result, opening of a door by the vehicle occupant may be problematic in the event of a power interruption, such as in the case of a battery or circuit failure.

Indeed, a common problem related to e-latches is that of controlling opening and closing of the doors in the case of failure of the main power supply of the vehicle. Additionally, interruptions or breaking of the electrical connection between the main power supply and the electric motor in the e-latch can lead to similar control issues. Such interruptions or breaking of the electrical connection can occur, for example, in case of an accident or crash involving the vehicle. Enabling the opening and closing of the doors in these situations, however, is generally mandated by vehicle regulations.

Thus, it is known to use a backup power source for the e-latch in order to supply electrical energy to the electric motor of the latch, in case of failure or interruption of the vehicle main power supply. EP 0 694 664 A1 discloses a backup energy source for an electrical door latch designed to supply power to the latch during emergency situations and which includes an auxiliary battery arranged within the door in order to power the release of the striker from the ratchet to facilitate opening of the door by the vehicle occupant. WO2014/102282 discloses a backup energy source for an electrical door latch that is designed to supply power to the electric motor during emergency situations and which includes a super capacitor group configured to store energy during normal operating conditions and supply a backup supply voltage to the electric motor during failure operating conditions. Such electrical latches are not designed, however, to provide proper operation of the cinching mechanism commonly associated with a "soft close" function of electrical latches.

Accordingly, there remains a need for improved e-latch assemblies and methods of operation thereof that enable operation of the e-latch assembly including cinching operations without the main power supply and without relying on complex mechanical designs.

SUMMARY

This section provides a general summary of the present disclosure and is not a comprehensive disclosure of its full scope or all of its features and advantages.

It is an object of the present disclosure to provide an electrical latch assembly for use in a motor vehicle closure system that addresses and overcomes the above-noted shortcomings associated with conventional electrical latches.

Accordingly, it is an aspect of the present disclosure to provide an electrical latch assembly for a motor vehicle closure system having an actuation group including latching mechanism having a ratchet and a pawl, and a cinching mechanism having a cinching lever operatively coupled to the ratchet and moveable between a cinched position and an uncinched position. The actuation group also includes an electric motor for actuating the cinching lever. The electric latch assembly also includes a control circuit including a control unit configured to generate a driving signal to operate the actuation group. The control unit is normally powered by a main power source of the vehicle. The control circuit also includes a backup energy source to provide power to the control circuit and the actuation group in the event a fault condition is experienced by the main power source. The control circuit is configured to act on the fault condition and switch powering of the control unit from the main power source to the backup energy source as well as for returning the cinching lever to the uncinched position.

The electrical latch of the present disclosure is configured to provide the power switching function before the movement of the cinching lever from a cinched position to an uncinched position. As an alternative, the power switching function may occur during movement of the cinching lever from its cinched position to its uncinched position.

According to another aspect of the disclosure, an e-latch assembly for a closure member of a vehicle is provided. The e-latch assembly includes an actuation group having a latching mechanism operable to selectively secure the closure member. The actuation group also includes a cinching mechanism moveable between a cinched position and an uncinched position. An electronic control circuit is coupled to a main power source and to the actuation group. The electronic control circuit includes a backup energy source and a control unit. The control unit is configured to detect a fault condition of the main power source. The control unit is additionally configured to selectively move the cinching mechanism to the uncinched position using power from the energy backup source in response to the detection of the fault condition of the main power source to allow opening of the closure member.

According to yet another aspect of the disclosure, a method of operating an e-latch assembly coupled to a closure member includes the step of moving a cinching mechanism from an uncinched position to a cinched position using power from a main power source. The method proceeds to the step of detecting a fault condition of the main power source while the cinching mechanism is moving to the cinched position. Then, the next step of the method is moving the cinching mechanism to the uncinched position using power from a backup energy source in response to the detection of the fault condition of the main power source. Next, the method proceeds to the step of detecting whether the e-latch assembly is latched in response to the fault condition of the main power source not being detected. The method continues with the step of moving the cinching mechanism to the uncinched position using power from the main power source in response to the e-latch assembly being latched. Then, moving the cinching mechanism to the cinched position using power from the main power source in response to the e-latch assembly not being latched. The method then includes the step of detecting the fault condition of the main power source while moving the cinching mechanism to the uncinched position. The method concludes with the step of moving the cinching mechanism to the uncinched position using power from the backup energy source in response to the detection of the fault condition of the main power source while moving the cinching mechanism to the uncinched position.

The present disclosure is directed to providing an e-latch equipped with a cinching mechanism with the additional control feature of intentionally returning the cinching mechanism to its uncinched mode in response to switching power from the main power source to the backup power source. This feature of returning/resetting the cinching mechanism to its uncinched mode is provided when the power loss is detected during a cinching operation or an uncinching operation. This return of the cinching mechanism to its uncinched mode upon detection of the fault, regardless of the current status of the cinching mechanism, results in setting the latching mechanism to permit release of the door.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

In the following description, details are set forth to provide an understanding of the present disclosure. In some instances, certain circuits, structures and techniques have not been described or shown in detail in order not to obscure the disclosure.

In general, the present disclosure relates to an electronic latch or e-latch of the type well-suited for use in many vehicular closure applications. The e-latch assembly and associated methods of operation of this disclosure will be described in conjunction with one or more example embodiments. However, the specific example embodiments disclosed are merely provided to describe the inventive concepts, features, advantages and objectives will sufficient clarity to permit those skilled in this art to understand and practice the disclosure. Specifically, the example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Referring to the Figures, wherein like numerals indicate corresponding parts throughout the several views, an electronic latch for a motor vehicle closure system and a method of operating the electronic latch are disclosed.

Figure 1:
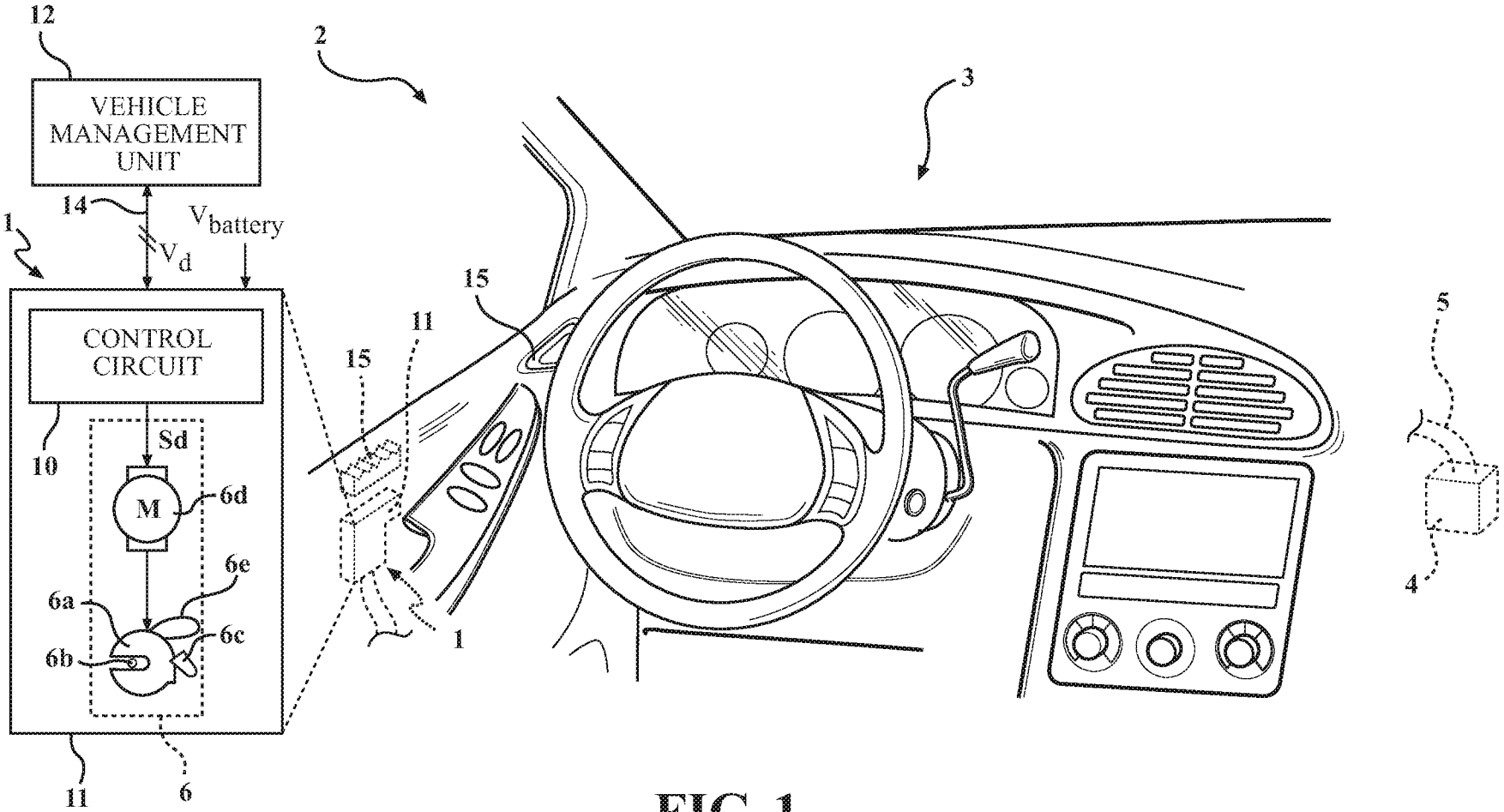
FIG. 1 illustrates an electrical latch assembly (e-latch assembly) functionally and operatively arranged in association with a door of a motor vehicle.
Figure 2:
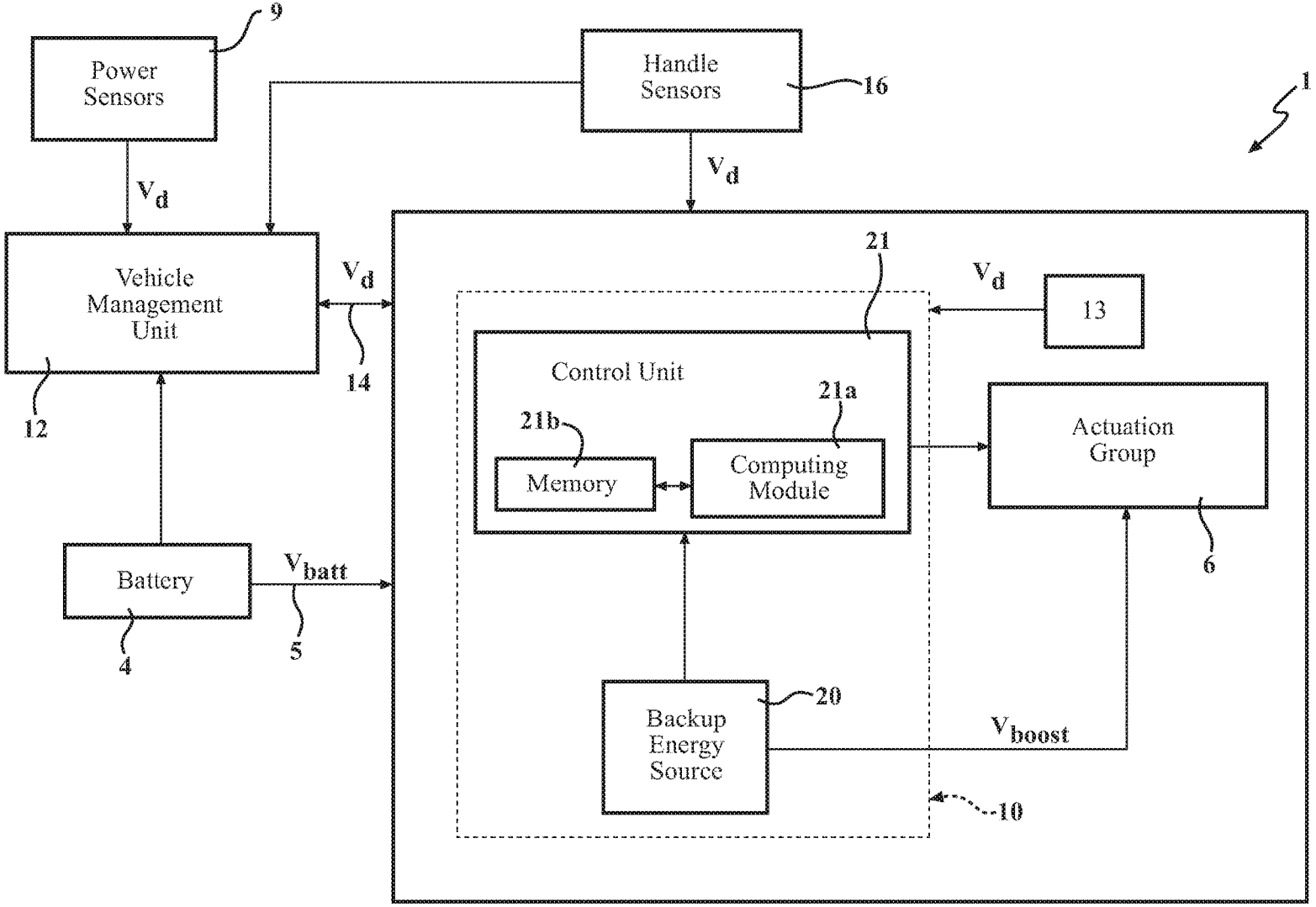
FIG. 2 is a schematic illustration of an electronic control circuit operably associated with the e-latch assembly of FIG. 1.

Number 1 in FIGS. 1 and 2 indicates as a whole an electronic latch assembly (hereinafter e-latch assembly 1), coupled to a closure panel (e.g. door 2) of a motor vehicle 3. It should be understood that the e-latch assembly 1 can be coupled to any kind of closure device of the motor vehicle 3, such as, but not limited to passenger doors, liftgates, trunk lids and hoods.

The e-latch assembly 1 is electrically connected to a main power source 4 of the motor vehicle 3, for example a main battery providing a battery voltage Vbatt of 12 V, through an electrical connection element 5, for example a power cable. The main power source 4 may also include a different source of electrical energy within the motor vehicle 3, such as an alternator, for example.

The e-latch assembly 1 is configured to include an actuation group 6 having one or more electric motor(s) **6*d* operable to control actuation of the door 2 (or in general control actuation of the vehicle closure device). In one possible embodiment, the actuation group 6 includes a latching mechanism having a ratchet 6*a* and a pawl 6*c*. Ratchet 6*a* is rotatably mounted to a latch housing 11 and is selectively rotatable to engage a striker 6*b* (fixed to the body of the motor vehicle 3, for example to the so called "A pillar" or "B pillar", in a manner not shown in detail). Ratchet 6*a* is rotatable between an unlatched (striker release) position, a secondary latched/closed (secondary striker capture) position and a primary latched/closed (primary striker capture) position and is normally biased toward the unlatched position. When the ratchet 6*a* is rotated into one of the latched positions with respect to the striker 6*b*, the door 2 is in a closed state, as either latched and cinched or latched and uncinched. Pawl 6*c* is also rotatably mounted to latch housing 11 and is moveable between a ratchet release position and one or more ratchet holding positions. Movement of pawl 6***c* to its ratchet release position permits ratchet 6*a* to move to its unlatched position. In contrast, movement of pawl 6*c* to its ratchet holding positions functions to hold ratchet 6*a* in one of its latched/closed positions. The pawl 6*c* is directly or indirectly driven by an electric motor 6*d* associated with a power actuator mechanism so as to move between its ratchet holding positions (e.g., a primary ratchet holding position for holding the ratchet 6*a* in its primary closed position and a secondary ratchet holding position for holding the ratchet 6*a* in its secondary closed position) and its ratchet release position. The pawl 6*c* is normally biased to continuously engage the ratchet 6*a*.

The actuation group 6 also includes a cinching mechanism that has a cinching lever 6*e* mounted within the housing 11 of the e-latch assembly 1. A spring (not shown) applies a biasing force against one side of the cinching lever 6*e* urging the cinching lever 6*e* towards the ratchet 6*a*, for example. Alternatively, the cinching lever 6*e* can be configured to engage or act directly on the striker 6*b*, rather than indirectly on the striker 6*b* via the ratchet 6*a*. The cinching mechanism also includes a cinch actuator such as, but not limited to, the electric motor 6*d*. The cinching lever 6*e* is configured to receive a driving engagement from the cinch actuator to provide driving movement/rotation of the cinching lever 6*e* towards a cinched position (i.e., cinching mechanism in the cinched mode or position) and/or a home or uncinched position (i.e., cinching mechanism in the uncinched mode or position). For example, the electric cinch motor 6*d* that drives the cinching lever 6*e* can be independent of the electric power release motor 6*d* which drives the pawl 6*c*. In the case of independent operation, the actuation group 6 of the e-latch assembly 1 can contain multiple electric motors 6*d*, namely the electric cinch motor 6*d* that drives the cinching lever 6*e* and the electric power release motor 6*d* which drives the pawl 6*c*. In any event, the electric motor(s) 6*d* is/are powered by the main power source 4 or an integrated backup energy source 20, as further described below. For convenience, the electric cinch motor 6*d* is referred to herein as the electric motor 6*d*.

The cinching lever 6*e* can be rotated to its cinched position which, in turn, causes the ratchet 6*a* to be rotated until the pawl 6*c* engages into its primary ratchet holding position and thus holds or otherwise retains the ratchet 6*a* in its primary closed position. Once the cinch operation is complete, the cinch actuation mechanism that is controlled by the electric motor 6*d* "resets" for returning the cinching lever 6*e* to its uncinched position so as not to block the ratchet 6*a* from rotation into the release position once the pawl 6*c* is disengaged. Movement of the cinching lever 6*e* to the uncinched position also acts to release the ratchet 6*a* from the primary closed position and allow the ratchet 6*a* to move to its secondary closed position or to release the ratchet 6*a* from the secondary closed position and allow the ratchet 6*a* to move to its unlatched position.

As such, the cinching lever 6*e* of the actuation group 6 can be actuated by the electric motor 6*d* to cinch the e-latch assembly 1 from the secondary closed position to the primary closed position, as well as to return the cinching lever 6*e* to its uncinched position once the e-latch assembly 1 has been cinched. It is recognized that the cinched position can be defined as engagement of the cinching lever 6*e* with the ratchet 6*a* and/or striker 6*b* to drive the ratchet 6*a* into the latched primary closed position of the e-latch assembly 1 (e.g. the door 2 is locked and cinched). It is recognized that the uncinched or home position can be defined as disengagement of the cinching lever 6*e* from the ratchet 6*a* and/or striker 6*b*. In the uncinched position or home position of the cinching lever 6*e*, the ratchet 6*a* is held engaged with the striker 6*b* in the primary closed position by the pawl 6*c*.

The e-latch assembly 1 further includes an electronic control circuit 10, for example including a microcontroller or other known computing unit (discussed in detail below). The electronic control circuit 10 is coupled to the actuation group 6 and provides suitable driving signals Sd to the electric motor 6*d*.

In a possible embodiment, the electronic control circuit 10 is conveniently embedded and arranged in a same housing or case 11 (shown schematically) together with the actuation group 6 of the e-latch assembly 1, thus providing an integrated compact and easy-to-assemble unit.

The electronic control circuit 10 is also electrically coupled to a vehicle management unit 12 which is configured to control general operation of the motor vehicle 3 via an electrical connection element 14 (e.g., a data bus), so as to exchange signals, data, commands and/or information Vd indicative of a state of the vehicle 3. Such information and/or signals Vd may include, for example, positioning of the individual components of the actuation group 6, state of the main power source 4, and/or circuit integrity of the main power source 4 connection to the electronic control circuit 10, and/or vehicle management system 12.

The vehicle management unit 12 is additionally coupled to electrical system sensors 9, for example voltage, current and/or power sensors, which can provide signals Vd to the vehicle management unit 12 and/or the control circuit 10. The signals Vd from the electrical system sensors 9 can include information such as, but not limited to the state of the main power source 4 and electrical connections of same to the e-latch assembly 1, as well as current lock state of the e-latch assembly 1.

Conveniently, the electronic control circuit 10 receives feedback information about the latch actuation status from the position sensors 13, such as Hall sensors, configured to detect the operating position of the actuation group 6 (e.g. locked state, unlocked state, opened state, closed state, cinched state, uncinched state, etc.), for example of the ratchet 6*a* and/or pawl 6*c* and/or cinching lever 6*e* and/or striker 6*b*; and also receives (directly and/or indirectly via the vehicle management unit 12) information Vd about user actuation of the vehicle (external and/or internal) handles 15 from handle sensors 16, which detect user activation of the internal and/or external handles 15 of the doors 2 of the motor vehicle 3.

The electronic control circuit 10 can also be coupled to the main power source 4 of the motor vehicle 3, so as to receive the battery voltage Vbatt whereby the electronic control circuit 10 is able to check if the value of the battery voltage Vbatt decreases below a predetermined threshold value.

In more detail, the electronic control circuit 10 includes a control unit 21, for example provided with a microcontroller, microprocessor or analogous computing module 21*a*, that is coupled to the backup energy source 20 and the actuation group 6 of the e-latch assembly 1 (providing thereto the driving signal Sd), to control their operation. The power to generate the driving signals Sd as well as operational power for the electric motor 6*d* can be provided by the main power source 4, and in the event of a fault condition of the main power source 4 then the power is provided by the backup energy source 20 (as further described below in relation to a power management procedure or method 100 of operating the e-latch assembly 1—see FIG. 3).

The control unit 21 also has an embedded memory 21*b*, for example a non-volatile random access memory, coupled to the computing module 21*a*, storing suitable programs and computer instructions (for example in the form of a firmware). It is recognized that the control unit 21 could alternatively comprise a logical circuit of discrete components to carry out the functions of the computing module 21*a* and memory 21*b*, including acting upon the vehicle state signals Vd, handle sensor 16 signals Vd, position sensor 13 signals Vd, and/or detected or otherwise recognized fault condition (s) of the main power source 4 from the electrical system sensors 9, as further described below.

The control unit 21 is configured to control the e-latch assembly 1 for controlling actuation of the door 2 based on signals Vd detected by the handle sensors 16 which are indicative, for example, of the user intention to open the door 2 of the motor vehicle 3, and optionally based on signals Vd received from the vehicle management unit 12 which are indicative, for example, of a correct authentication of the user carrying suitable authentication means (such as in a key fob) and/or as indication of the state of the vehicle 3 (one or more detected or otherwise recognized fault conditions of the main power source 4). It is also recognized that the handle sensors 16 can include signals Vd generated due to operation of buttons or other release controls by the vehicle occupant (e.g. hatch or trunk release lever or button located inside of the vehicle 3).

According to a particular aspect, the control unit 21 is also configured to manage pull signals Vd received from the handle sensors 16 and to implement a suitable control algorithm to control the same e-latch assembly 1 to facilitate release of the striker 6*b* from the ratchet 6*a* of the actuation group 6 of the e-latch assembly 1. The electronic control circuit 10 is also configured to implement a suitable control algorithm to facilitate appropriate positioning of the cinching lever 6*e*, associated with the cinching mechanism, via the method 100 of operating the e-latch assembly 1, as further described below. It is noted that release of the striker 6*b* is dependent upon appropriate positioning of the cinching lever 6*e* (e.g. in the uncinched position) within the actuation group 6.

Further, the signals Vd can be interpreted by the vehicle management unit 12 and/or a control unit 21 to represent one or more of a variety of state conditions experienced by the vehicle 3 and/or the e-latch assembly 1. For example, the state conditions can be fault condition(s) of the main power source 4 (including connection circuit failure between the main power source 4 and the e-latch assembly 1), operational position of components in the actuation group 6 (including the position of the cinching lever 6*e* with respect to lock state of the e-latch assembly 1), and/or emergency conditions of the vehicle 3 itself (e.g. a crash condition). It is also recognized that fault condition(s) of the main power source 4 can include failure of the battery and/or alternator considered as part of the main power source 4. As such, it is recognized that operation of the cinching mechanism for moving the cinching lever 6*e* toward its cinched position under influence of the control unit 21 can be referred to as a cinch operation mode, whereby positioning of the cinching lever 6*e* is controlled to position the ratchet 6*a* in a latched and cinched position (e.g. the primary closed position of the e-latch assembly 1). Alternatively, operation of the cinching mechanism for moving the cinching lever 6*e* toward its home/uncinched position under influence of the control unit 21 can be referred to as a cinch homing operation mode, whereby positioning of the cinching lever 6*e* is controlled to move the cinching lever 6*e* from its cinched position to its uncinched position (e.g. home cinch state of the e-latch assembly 1). As discussed below, interruption of any of the operation modes of the cinching lever 6*e* can occur due to a fault condition of the main power source 4.

In particular, the control unit 21 can, in view of receiving from the vehicle management unit 12 the vehicle state information signal Vd (e.g. indicative of one or more fault conditions of the main power system 4), position sensor 13 signals (e.g. indicative of latched state of the e-latch assembly 1), and/or door actuation signals Vd received from the handle sensors 16 (e.g. indicative of desire of vehicle 3 occupant to open the door 2), start, or otherwise complete the method 100 of operating the e-latch assembly 1 (see FIG. 3), internally to the e-latch assembly 1, in order to provide for opening of the doors 2 of the motor vehicle 3 in the event of fault(s) being experienced by the main power system 4 at the beginning of and/or in the midst of actuation group 6 operation. It is recognized that the method 100 of operating the e-latch assembly 1 provides for control of the cinching lever 6*e* being returned to its home or uncinched position based on a power interruption occurring during the cinching operation (i.e. the e-latch assembly 1 going from the secondary to the primary closed position) or based on a power interruption occurring during the uncinching operation (i.e. after the e-latch assembly 1 moved from the primary to the secondary closed position).

The electronic control circuit 10 can include the embedded and integrated backup energy source 20, which is configured to supply electrical energy to the latch electric motor 6*d* and to the same electronic control circuit 10, in case of failure or interruption of the main power source 4 of the motor vehicle 3.

The integrated backup energy source 20 can be a "passive" device accessed by the e-latch assembly 1, such that the backup energy source 20 is available to backup power the e-latch assembly 1 in the event that the main power source 4 is not available. For example, the current demanded by the e-latch assembly 1 (e.g. electric motor 6*d* and associated actuators) will draw from whichever source 4,20 has the highest voltage potential at the time of current draw using a control circuit, for example, comprised of diodes, resistors and other similar solid state devices well known in the art of electric circuit design. In the passive mode for the backup energy source 20, signals from the electrical system sensors 9 can be optionally reported to the control unit 21.

An example embodiment of the backup energy source 20 is now discussed. The backup energy source 20 can include a group of low voltage supercapacitors (hereinafter supercap group), as an energy supply unit (or energy tank) to provide power backup to the e-latch assembly 1 even in case of power failures of the main power source 4. Supercapacitors may include electrolytic double layer capacitors, pseudocapacitors or a combination thereof. Supercapacitors advantageously provide high energy density, high output current capability and have no memory effects; moreover, supercapacitors have small size and are easy to integrate, have extended temperature range, long lifetime and may withstand a very high number of charging cycles. Supercapacitors are not toxic and do not entail explosive or fire risks, thus being suited for hazardous conditions, such as for automotive applications.

In a possible non-limiting embodiment, the supercap group can include two supercapacitor cells, connected in series, each providing, when charged, a voltage level for example of 2.5 V-2.7 V, in order to jointly provide a supercap voltage Vsc, for example in the order of 3 V-5 V, which may be used as a backup power supply 20 for the e-latch assembly 1, in emergency situations, when the energy from the main power source 4 of the motor vehicle 3 is not available. Supercapacitor cells are thus of a low voltage type and also can have a high capacity, for example in the order of 16 Farads-20 Farads, for example 18 Farads.

The backup energy source 20 can further include a charge module, an equalization module, and a boost module. The charge module associated with the backup energy source 20 is electrically coupled to the supercap group and is configured to continuously recharge, starting from the battery voltage Vbatt, when power from the main power source 4 is available so that the same supercap group can offer a full energy storage for emergency situations and any leakage currents are compensated.

The equalization module associated with the backup energy source 20 is electrically coupled to the supercap group and is configured to ensure that both supercapacitor cells have a desired cell voltage value, in particular a same cell voltage value during operation (to achieve a balanced operating condition). The equalization module also inhibits the supercapacitor cells from having a cell voltage exceeding a maximum desired cell voltage level, thereby protecting the supercapacitors against overcharging.

The boost module associated with the backup energy source 20 receives at its input the supercap voltage Vsc generated by the supercap group and is configured to boost, that is to increase, its value up to automotive standard voltages (for example 9 V-16 V) so as to provide enough output current capability to drive standard automotive electric motors, such as the electric motor 6*d* of the e-latch assembly 1. Indeed, the supercap voltage Vsc may be too low to provide an effective back-up power source to drive the electric motor 6*d* in emergency situations, like lost or insufficient power supply from main power source 4 of the motor vehicle 3. The boost module thus can provide at its output (that is also the output of the backup energy source 20) a boosted voltage Vboost, as a function of the supercap voltage Vsc.

The boosted voltage Vboost is then received by an output module, not shown, of the electronic control circuit 10, for example including an integrated H-bridge, whose output drives the electric motor 6*d* of the e-latch assembly 1.

The backup energy source 20 further includes a diagnostic module, which is operatively coupled to the supercap group and is configured to monitor the health status of the supercapacitors during the charging process by measuring their temperature, voltage value, capacitance value and/or internal equivalent resistance (DCR—Direct Current Resistance). The diagnostic module is also coupled to the control unit 21 to provide diagnostic information thereto, for example including the value of the supercap voltage Vsc. In a possible embodiment, not shown, the diagnostic module may be implemented in the control unit 21, as a diagnostic routine run by the microprocessor or microcontroller thereof.

Accordingly, any failure affecting the vehicle management unit 12 and/or the main power source 4 of the motor vehicle 3 does not affect the proper management of the vehicle closure devices (for example the door 2), even during emergency situations.

The use of supercapacitors can achieve high energy density, high capacity and high output current capability, and avoids memory effects and minimize consumption and recharge time. The lifetime of the supercapacitor group is also very high, thus allowing the use thereof as a reliable backup energy source, without requiring additional backup power sources. The use of low voltage supercapacitors, for example of the type commonly available in the market, can also reduce the costs of the system and improve its maintainability. The use of supercapacitors can provide the backup energy source 20 in a cheap, light and small package; the resultant size and form factor of the backup energy source 20 is such as to allow integration within the same case 11 of the e-latch assembly 1, together with a respective control unit 21, designed to manage the emergency situations.

The method 100 of operating the e-latch assembly 1 can execute independently from the availability of the main power source 4 of the motor vehicle 3, and the battery voltage Vbatt, thanks to the presence of the backup energy source 20, internally within the e-latch assembly 1, and independently from any failure of the electrical connections between the same e-latch assembly 1 and the vehicle management unit 12 and/or from failures of the same vehicle management unit 12.

Figure 3:
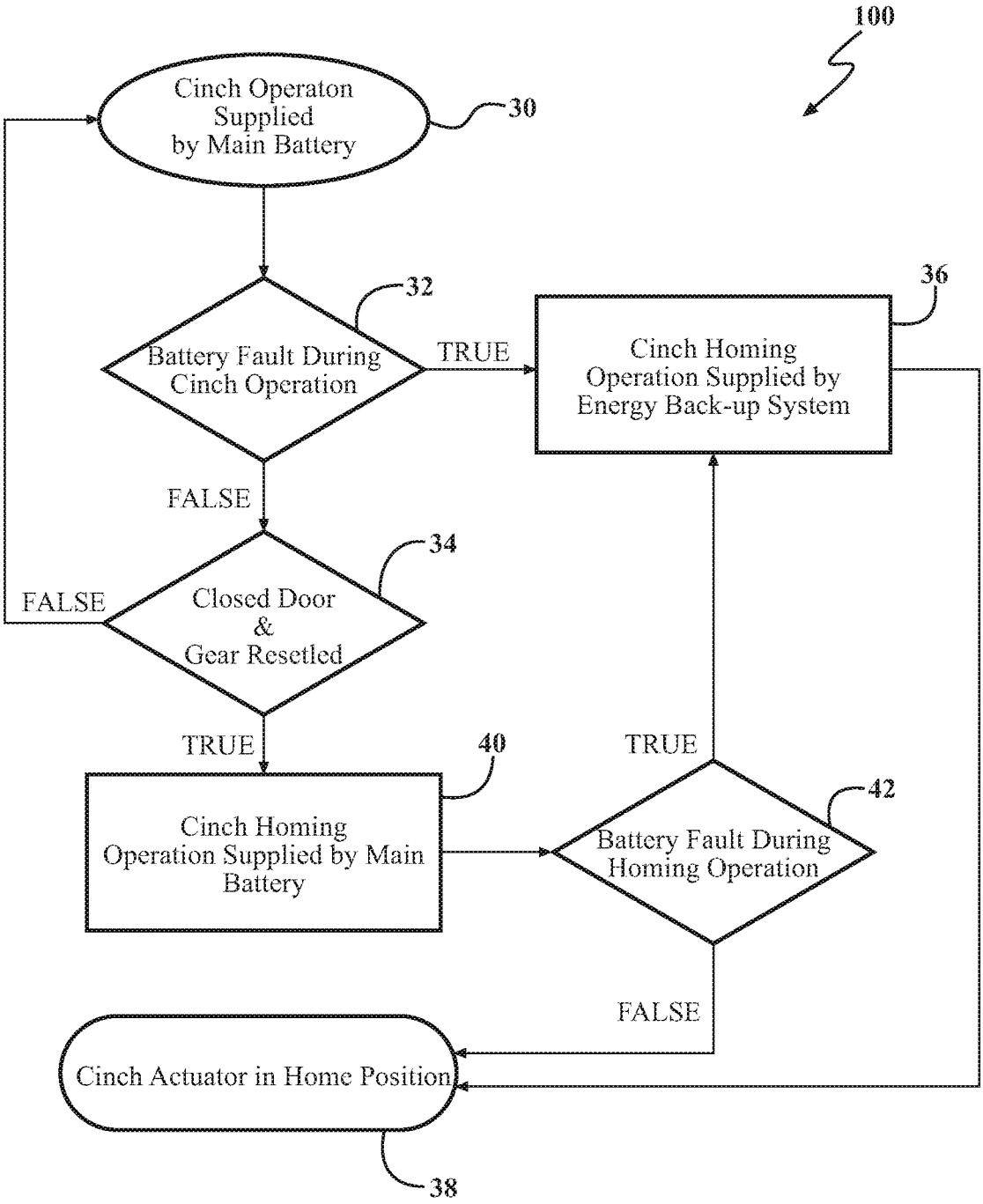
FIG. 3 is a flowchart illustrating the steps of a method for operating the e-latch assembly of FIG. 1 implemented by the electronic control circuit of FIG. 2.

In detail, and as shown in FIG. 3, the power management procedure or method 100 of operating the e-latch assembly 1 and implemented by the control unit 21 includes a step 30 of moving the cinching mechanism to a cinched position using power from a main power source 4. In more detail, this cinch operation mode is powered by the main power source 4 as the control unit 21 controls actuation (via the computing module 21*a*) of the actuation group 6. The step 30 of moving the cinching mechanism to the cinched position using power from a main power source 4 can include, for example, moving the cinching lever 6*e* towards its cinched position using driving signals Sd to position the cinching lever 6*e* via instructions to the electric motor 6*d*. The method 100 can proceed with the step 32 of detecting a fault condition of the main power source 4 while moving the cinching mechanism to the cinched position. More specifically, the step 32 of detecting a fault condition of the main power source 4 while moving the cinching mechanism to the cinched position can include monitoring electrical system sensors 9. As discussed above, the electrical system sensors 9 can indicate an operational state of the main power source 4 and signals Vd from the electrical system sensors 9 may be received/recognized by the vehicle management system 12 and/or control unit 21. Signals Vd indicative of normal operation of the main power source would, for example, be identified as fault condition false or no fault condition registered via the computing module 21*a*.

The method 100 continues by detecting whether the e-latch assembly 1 is latched in response to the fault condition of the main power source 4 not being detected. This step 34 may be further defined as detecting whether the door 2 is closed and the e-latch assembly 1 is latched in response to the fault condition of the main power source not being detected. Thus, if a fault condition of the main power source 4 is not detected, at step 34 it is determined (via the computing module 21*a*) whether the door 2 is closed and gears reset (e.g., the e-latch assembly 1 is in a latched state). In this manner by steps 30,32,34, the control unit 21 sends the driving signals Sd and controls operation of the actuation group 6 (via the computing module 21*a*) to place the e-latch assembly 1 in the primary closed position with the cinching lever 6*e* latched in the cinched position (i.e., cinching mechanism in the cinched position). If the door 2 is not closed or the e-latch assembly 1 is not latched at step 34, the method 100 includes the step of moving the cinching mechanism to a cinched position using power from the main power source 4 in response to one of the door 2 not being closed and the e-latch assembly 1 not being in the latched position.

Alternatively at step 32, a fault condition of the main power source 4 may be detected/recognized. In more detail, a fault condition of the main power source 4 is detected/recognized when the signals Vd from the electrical system sensors 9 indicate failed operation of the main power source 4. Signals Vd indicative of failed operation of the main power source 4 would, for example, be identified as fault condition true or a fault condition registered via the computing module 21*a*. In such a situation, the method 100 can proceed to step 36 of moving the cinching mechanism to the uncinched position using power from the backup energy source 20 in response to the detection of the fault condition of the main power source 4. The cinching homing operation concludes when the cinching mechanism is in the home or uncinched position at step 38. So, the control unit 21 recognizes/identifies (via the computing module 21*a*) that the main power source 4 has failed and then initiates a "switching" of the power source of the control unit 21 to the backup energy source 20 and begins the cinch homing operation mode in order to place the e-latch assembly 1 in the secondary closed position (i.e. the cinching lever 6*e* is in the uncinched position as completed at step 38 before the e-latch assembly 1 was positioned in the primary closed position). In this manner by steps 30,32,36,38, the control unit 21 sends the driving signals Sd (via the computing module 21*a*) and controls operation of the actuation group 6 to place the e-latch assembly 1 in the secondary closed position with the cinching lever 6*e* being placed into its home or uncinched position. Therefore, the door 2 can subsequently be opened by the vehicle occupant when the e-latch assembly 1 is in the uncinched state (which includes the cinching lever 6*e* in the uncinched position) by releasing the ratchet 6*a* from the striker 6*b* in response to activation of the handle sensors 16.

Furthermore, if there is no fault condition in the main power source 4 as determined at step 32 and e-latch assembly 1 is determined to be latched at step 34 (e.g., the pawl 6*c* is in the primary ratchet holding position), the method 100 continues with the step of moving the cinching mechanism to an uncinched position using power from the main power source 4 in response to the e-latch assembly 1 being in the latched position. More specifically, since step 34 includes detecting whether the door 2 is closed, the step of moving the cinching mechanism to an uncinched position using power from the main power source 4 in response to the e-latch assembly 1 being in the latched position can be further defined as the step 40 of moving the cinching mechanism to an uncinched position using power from the main power source 4 in response to the door 2 being closed and e-latch assembly 1 being in the latched position. So, at step 40, the control unit 21 starts (via the computing module 21*a*) the uncinch operation mode (e.g. homing mode) of the actuation group 6 by sending driving signal(s) Sd to move the cinching lever 6*e* towards its home or uncinched position. The method 100 continues with the step 42 of detecting a fault condition of the main power source 4 while moving the cinching mechanism to the uncinched position. If no fault condition of the main power source 4 is detected while moving the cinching mechanism to the uncinched position in step 42, the cinch actuation mechanism concludes in the home or uncinched position at step 38. In this manner by steps 34,40,42,38, the control unit 21 sends the driving signals Sd (via the computing module 21*a*) and controlled operation of the actuation group 6 to move the e-latch assembly 1 from the secondary closed position into the primary closed position with the cinching lever 6*e* being placed into the home or uncinched position, by the control unit 21 using the main power source 4 to power operation of the actuation group 6 and control circuit 10.

However, if after commencement of the uncinch operation mode at step 40 (under power by the main power source 4), the fault condition of the main power source 4 is detected, the method continues with the step 36 of moving the cinching mechanism to the uncinched position using power from the backup energy source 20 in response to the fault condition of the main power source 4 being detected while moving the cinching mechanism to the uncinched position. Again, the fault condition of the main power source 4 can, for example, be recognized at step 42 via sensor signals Vd by the control unit 21 as fault condition true via the computing module 21*a*. Thus, the control unit 21 (via the computing module 21*a*) recognizes that the main power source 4 has failed and switches the power source of the control unit 21 to the backup energy source 20 and continues the uncinch operation mode, as begun in step 40, in order to place the e-latch assembly 1 into the primary closed position (i.e. the cinching lever 6*e* is in the uncinched position as completed at step 38). In this manner by steps 34,40,42,36,38, the control unit 21 sends the driving signals Sd (via the computing module 21*a*) and controls operation of the actuation group 6 to place the e-latch assembly 1 in the primary closed position (with the cinching lever 6*e* being placed into the home or uncinched position) while switching from the main power source 4 to the backup energy source 20 during the uncinching operation mode. So, in such a situation, the switch from the main power source 4 to the backup energy source 20 occurs after start of the uncinching mode operation.

In view of the above, either before, after or during the cinch mode operation or the uncinch mode operation, if the fault condition occurs with the main power source 4, the cinching mechanism is returned to its uncinched position, whereby the vehicle occupant is able to perform a subsequent release of the door 2 (as facilitated by the uncinch operation mode implemented by the control unit 21 using the energy backup source 20). In other words, if the fault condition occurs during either the cinch or the homing operation modes, reset of cinching lever 6*e* into its home (e.g. uncinched) position is facilitated by power supplied to the actuation group 6 from the backup energy source 20, as sourced by the control unit 21 due to switching power sources (via the computing module 21*a*) from the main power source 4 to the backup energy source 20 upon receipt or other indication of the fault condition (i.e. fault condition true).

As such, the method 100 of operating the e-latch assembly 1 of FIG. 3 provides embodiments of operation of the cinching lever 6*e* under influence of the main power source 4 and/or the backup energy source 20, either before, during or after implementation of the cinching (step 30 under initial control of the main power source 4) or uncinching (step 40 under initial control of the main power source 4) mode operation by the control unit 21 of the actuation group 6. It is recognized that the control unit 21 can wait for the occurrence of signals Vd, for example by monitoring the signals Vd received from the handle sensors 16, position sensors 13 and/or signals from electrical system sensors 9. The handle activation signal Vd can be generated by the handle sensors 16 in any known manner, for example based on the activation of the handle 15 by the vehicle user. The power signal Vd indicating a fault condition with the main power source 4 can be generated by the electrical system sensors 9 in any known manner, for example based on detection of a voltage drop (battery malfunction), a current drop (e.g. open circuit fault), etc. The position sensors 13 can be used to provide input signals Vd to the control unit 21 indicating that the ratchet 6*a*, pawl 6*c* and striker 6*b* are in the primary closed position and thus are in position to start the uncinching operation mode in order to place the e-latch assembly 1 in the secondary closed position.

Advantageously, the signals Vd can be received at an interrupt port of the control unit 21, so as to be promptly processed by the same control unit 21 via the computing module 21*a* in order to recognize a) the signal Vd as a fault condition true or fault condition false in the case of a main power source 4 failure/interruption, b) the signal Vd as a door open signal for example by handle 15 actuation by the vehicle 4 occupant, and/or c) the e-latch assembly 1 is in the primary closed position. It is also recognized that presence or absence of the signals Vd can be interpreted by computing module 21*a* as meaning that a change in state of the e-latch assembly 1 is desired by the vehicle occupant (e.g. from latched to unlatched or from unlatched to latched), for example the signal Vd is provided to the control unit 21 from the handle sensors 16 when actuated. It is also recognized that presence or absence of the signal Vd can be interpreted by computing module 21*a* as meaning that a change in state of the main power source 4 has occurred (e.g. from normal operation to fault condition or from fault condition to normal operation), for example the signal Vd is provided to the control unit 21 from the vehicle management system 12 and/or the electrical system sensors 9 when the main power source 4 fails or is otherwise interrupted in order to indicate or otherwise signal a fault condition.

As discussed above, the control unit 21 is configured to disable or enable the actuation group 6 from actuating the striker 6*b* of, or any other mechanical latching element coupled thereto (i.e. the cinching lever 6*e*), door 2 and/or the electric motor 6*d* from driving the actuation group 6. In a possible solution, the control unit 21 can read the sensors 9,13,16, and choose to avoid or enable any electric motor or other means of actuation (intended to release or open doors 2 as facilitated by the cinching lever 6*e* being placed in the uncinched position) based on the sensed conditions provided by the sensors 9,13,16 and/or the vehicle management unit 12. In particular, it is again emphasized that the e-latch assembly 1 may operate any kind of closure devices within the motor vehicle 3, different from the doors 2 thereof.

Embodiments according to the present description may not entail any modification of the vehicle management unit 12 or any vehicle parts outside the e-latch assembly 1; only a software modification may be required in the vehicle management unit 12 for suitable generation of the signals Vd, designed to start the method 100 of operating the e-latch assembly 1.

In particular, arrangement of the control unit 21 and the backup energy source 20 within the e-latch assembly 1 makes up for a compact and easy to integrate solution, which may also allow easy upgrading of existing vehicles. Thus, the present disclosure provides a power cinch type of e-latch with the ability to utilize power from the backup energy source (upon detection of a fault associated with the main power source) to automatically reset the cinching mechanism into its uncinched or home mode regardless of the operational condition of the cinching mechanism which existed prior to the fault detection.

Clearly, changes may be made to what is described and illustrated herein without, however, departing from the scope defined in the accompanying claims. The e-latch assembly 1 may operate any kind of different closure devices within the motor vehicle 3, for example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure. Those skilled in the art will recognize that concepts disclosed in association with an example switching system can likewise be implemented into many other systems to control one or more operations and/or functions.

What is claimed is:

1. A latch assembly for a closure member of a motor vehicle, the latch assembly comprising:
   - an actuation group including a latching mechanism operable to control latching of the closure member, a cinching mechanism operable to shift the latching mechanism between a cinched mode and an uncinched mode, and an electric motor controllable to drive the cinching mechanism;
   - a backup energy source to provide power to a control unit and to the actuation group; and
   - a control circuit including the control unit configured to generate a driving signal for operating the actuation group in order to actuate the cinching mechanism using power from a main power source when power from the main power source is available, and configured to generate the driving signal for resetting the cinching mechanism to the uncinched mode using power from the backup energy source when power from the main power source is unavailable.

2. The latch assembly as set for in claim 1, wherein the control unit is configured to detect a fault condition of the main power source, and upon detection of the fault condition automatically resets the cinching mechanism into its uncinched position.

3. The latch assembly as set forth in claim 1, wherein the control circuit is further configured to switch powering of the control unit and the actuation group from the main power source to the backup energy source before actuating the electric motor for resetting the cinching mechanism to the uncinched mode.

4. The latch assembly as set forth in claim 1, wherein the control circuit is further configured to switch powering of the control unit and the actuation group from the main power source to the backup energy source during the cinch mode.

5. The latch assembly as set for in claim 2, wherein the control unit is configured to detect a fault condition of the main power source while moving the cinching mechanism in the cinched mode.

6. The latch assembly of claim 2, wherein the control unit is configured to generate the driving signal for resetting the cinching mechanism to the uncinched mode upon detection of the fault condition.

7. The latch assembly of claim 2, wherein the control unit is configured to disable the actuation group from releasing the closure member before the cinching mechanism is returned to its uncinched position.

8. The latch assembly as set forth in claim 1, wherein the latching mechanism includes a ratchet selectively engaging a striker fixed to the closure member and a pawl selectively engaging the ratchet, wherein the cinching mechanism includes a cinching lever operatively coupled to the ratchet and moveable between an uncinched position and a cinched position, and wherein the electric motor is operable for moving the cinching lever between its uncinched and cinched positions.

9. The latch assembly as set forth in claim 8, wherein the cinching lever is configured to restrict movement of the ratchet in response to the cinching lever being in its cinched position and to release the ratchet in response to the cinching lever being in its uncinched position.

10. The latch assembly as set forth in claim 9, wherein the control unit is further configured to move the cinching lever to its uncinched position using power from the backup energy source in response to a fault condition being detected by the control unit.

11. The latch assembly as set forth in claim 9, wherein the control unit is further configured to move the cinching lever to its uncinched position using power from the backup energy source upon receipt of a signal from a vehicle management unit.

12. A latch assembly for a closure member of a motor vehicle, the latch assembly comprising: an actuation group including a latching mechanism operable to control latching of the closure member; a cinching mechanism operable to shift the latching mechanism between a cinched mode and an uncinched mode; an electric motor controllable to drive the cinching mechanism; and a control circuit including a control unit normally powered by a main power source of the vehicle and configured to generate a driving signal for operating the actuation group in order to actuate the cinching mechanism, and a backup energy source to provide power to the control unit and the actuation group in the event of a fault condition experienced by the main power source, the control circuit being configured to act in response to the fault condition for switching powering of the actuation group and the control unit from the main power source to the backup energy source and further configured to act in response to the fault condition for resetting the cinching mechanism to the uncinched mode using power from the backup energy source.

* * * * *